United States Patent [19]

Stemler et al.

[11] Patent Number: 4,709,435

[45] Date of Patent: Dec. 1, 1987

[54] BRIDGE DECK SYSTEM

[75] Inventors: J. Robert Stemler, Murrysville; James D. Klingensmith, Apollo; Craig C. Menzemer, Murrysville; John M. Kulicki, Mechanicsburg; Nicholas D. Theofanis, Camp Hill, all of Pa.

[73] Assignee: Aluminum Company of America, Pittsburgh, Pa.

[21] Appl. No.: 10,785

[22] Filed: Feb. 4, 1987

[51] Int. Cl.[4] ..... E01D 19/12

[52] U.S. Cl. ..... 14/73; 14/16.1; 52/544; 248/DIG. 1; 404/54; 404/57

[58] Field of Search ..... 14/16.1, 16.5, 17, 73; 52/177, 483, 489, 544; 248/DIG. 1; 404/53, 54, 56, 57

[56] References Cited

U.S. PATENT DOCUMENTS

| | | | |
|---|---|---|---|
| 1,929,478 | 10/1933 | Bunker | 72/70 |
| 2,920,850 | 1/1960 | Campbell | 248/DIG. 1 X |
| 3,484,882 | 12/1969 | Blanchette | 14/16.1 |
| 4,129,917 | 12/1978 | Sivachenko et al. | 14/73 |
| 4,403,759 | 9/1983 | Hicks | 248/DIG. 1 X |

FOREIGN PATENT DOCUMENTS

| | | | |
|---|---|---|---|
| 2006591 | 8/1971 | Fed. Rep. of Germany | 14/16.1 |
| 3244576 | 6/1984 | Fed. Rep. of Germany | 14/17 |

OTHER PUBLICATIONS

"Aluminum Orthotropic Bridge Deck", by W. M. Rogerson et al, *Civil Engineer-ASCE*, Nov. 1967, pp. 65–70.

*Primary Examiner*—Stephen J. Novosad
*Assistant Examiner*—John F. Letchford
*Attorney, Agent, or Firm*—Max L. Williamson

[57] ABSTRACT

A system for attaching a bridge deck panel to a bridge structure which allows the panel to expand in lengthwise and sidewise directions independent of a bridge deck support structure. Brackets attached to members of a bridge deck support structure have undercuts on opposing ends which accommodate flanges on the bridge deck panel. Portions of the bracket overlying the undercut and flange prevent the deck panel from being separated from the deck support structure, but do not prevent the deck panel from lengthwise movement independent of the bridge structure due to temperature changes. To enable the panel to move in a sidewise direction, a space is provided between the outermost edge of the deck panel flange and the length of the undercut.

6 Claims, 13 Drawing Figures

BRIDGE DECK SYSTEM

BACKGROUND

This invention relates to a bridge deck system and, more particularly, to a system for attaching a prefabricated bridge deck panel to a bridge structure.

A bridge deck is that portion of the bridge which supports and transfers traffic loads to the primary structure of the bridge. It may be a steel-reinforced, poured-in-place concrete structure or may be made up of prefabricated assemblies. Bunker U.S. Pat. No. 1,929,478, for example, describes a prefabricated floor slab having a steel pan which contains a steel-reinforcing bar or mesh welded to the pan and filled with concrete or other filling material. The pan may be attached to flanges of underlying beams with bolts, by welding, or with clamps which are bolted to the pan and underlie the beam flange. Orthotropic designs are also particularly suitable for making bridge deck structures. The November 1967 issue of *Civil Engineering—ASCE* magazine includes an article entitled "Aluminum Orthotropic Bridge Deck" which describes a bridge deck panel system which was used in 1967 on the Smithfield Street bridge in Pittsburgh, Pa. to replace the existing bridge deck. At least one reason an aluminum orthotropic design was used was to minimize the dead weight as much as possible. The bridge was 85 years old at the time, and in order to raise the load limit to suitable levels of 1967 traffic, it was necessary to minimize the dead load of the new deck. The aluminum deck was fabricated from aluminum plate welded to ribbed extrusions. The extrusions are substantially U-shaped in cross section with the legs of the U sloping slightly upwardly and outwardly from the base. Flanges extending outwardly from the base on each side are provided to attach the deck to the underlying bridge structure. Thus, the extrusions are frustoconical in cross section with the distance between the legs or ribs progressively increasing from their connection at the base to their free ends. The extrusions are assembled with the plate by welding the free ends of the ribs thereto. They are welded to the plate parallel with one another along the length of the plate and spaced uniformly apart, centerline to centerline, a distance of $16\frac{1}{8}$ inches. Spacing of the extrusions is an element of design of the deck to carry the anticipated traffic loads. The traffic side of the plate was coated with a sand impregnated polyester as a traction and wear surface. The panels were fabricated as large as possible consistent with the bridge dimensions since the weight of the complete deck was only 15 pounds per square foot. Thus, the panels were typically 10'9" wide by $27'7\frac{3}{8}''$ long, weighing approximately 4500 pounds, and were easily maneuvered and set in place on the bridge floor beams with a minimal amount of labor. To attach the deck to the bridge structure, the flanges on the ribbed extrusions were firmly bolted to floor beam flanges. Transverse joints between adjacent panels were filled with a $\frac{1}{4}$ inch bituminous filler board, and the longitudinal joint between panels was sealed with an acrylic terpolymer sealant to allow for expansion and contraction of the panels. Since the floor beams on the Smithfield Street bridge are also aluminum having substantially the same coefficient of expansion as the bridge deck, no provision was made in the connection between the deck and floor beam to accommodate a difference in movement between the deck and floor beams due to temperature change.

In 1983 the Federal Highway Administration reported to Congress that 45% of the 565,000 bridges in place in the United States were in need of repair. Of those bridges, it was estimated that as many as 65,000 have structural deficiencies which could be remedied by replacing the existing heavy deck systems with a lighter deck. It is not believed that these figures have substantially changed since that 1983 report. A large percentage of those bridges are steel fabricated having a steel floor beam system supporting the bridge deck. Because of its light weight and quick installation with minimal equipment and labor, an aluminum orthotropic bridge deck is particularly well suited for use in replacing deteriorated bridge decks. Since the coefficient of expansion of aluminum is approximately twice that of steel, an aluminum deck will be substantially more responsive to temperature changes than the underlying bridge structure. If the deck is restrained from movement at its connection with the bridge, the deck or connection may be stressed to unacceptably high levels and/or accelerate a fatigue failure from imposition of higher forces during stress reversal cycles. It is desirable, therefore, to provide a system for attaching a bridge deck to a bridge structure which will enable the deck to be securely anchored and yet free to move independently of the structure in response to changes in temperature.

SUMMARY OF THE INVENTION

A system of this invention includes a bridge deck prefabricated panel having a plurality of extruded, longitudinal ribbed members attached in a parallel arrangement to an aluminum traffic support plate. The extruded members have ribs projecting outwardly from each end of a web with the free ends of the ribs welded to the plate. Preferably, the ribs have an inside angle connection with the web of slightly greater than 90° giving the extruded member a frustoconical shape in cross section. A flange for attaching the deck to the bridge structure extends outwardly from each side of the member in line or substantially in line with the web. A polymer coating having an aggregate impregnated therein on the outer surface of the plate provides a traffic wear surface.

The size and configuration of the extrusion, thickness of the deck plate, spacing of the extrusion on the plate, etc., are determined by the design load on the bridge deck and the underlying bridge structure. To enable a bridge deck panel to move independent of the underlying steel members of the bridge structure, the panel is rigidly secured to the steel members at or near the panel's longitudinal midpoint. This is accomplished by a firm attachment of the extrusion's flanges at or near the panel midpoint to a flange of an underlying steel member. Connections between other steel members underlying the panel in either direction away from the panel midpoint and the panel are made by using a hold-down bracket which allows the panel to move or slide with respect to the bridge structure in a lengthwise or sidewise direction, but prevents the panel from upwardly disengaging from the bridge structure.

It is an objective of this invention to provide a bridge deck system which can expand and contract independent of the bridge structure to which the deck is attached.

This and other objectives and advantages will be more apparent with reference to the following description of a preferred embodiment and accompanying drawings.

DESCRIPTION OF A PREFERRED EMBODIMENT

Figure 1:
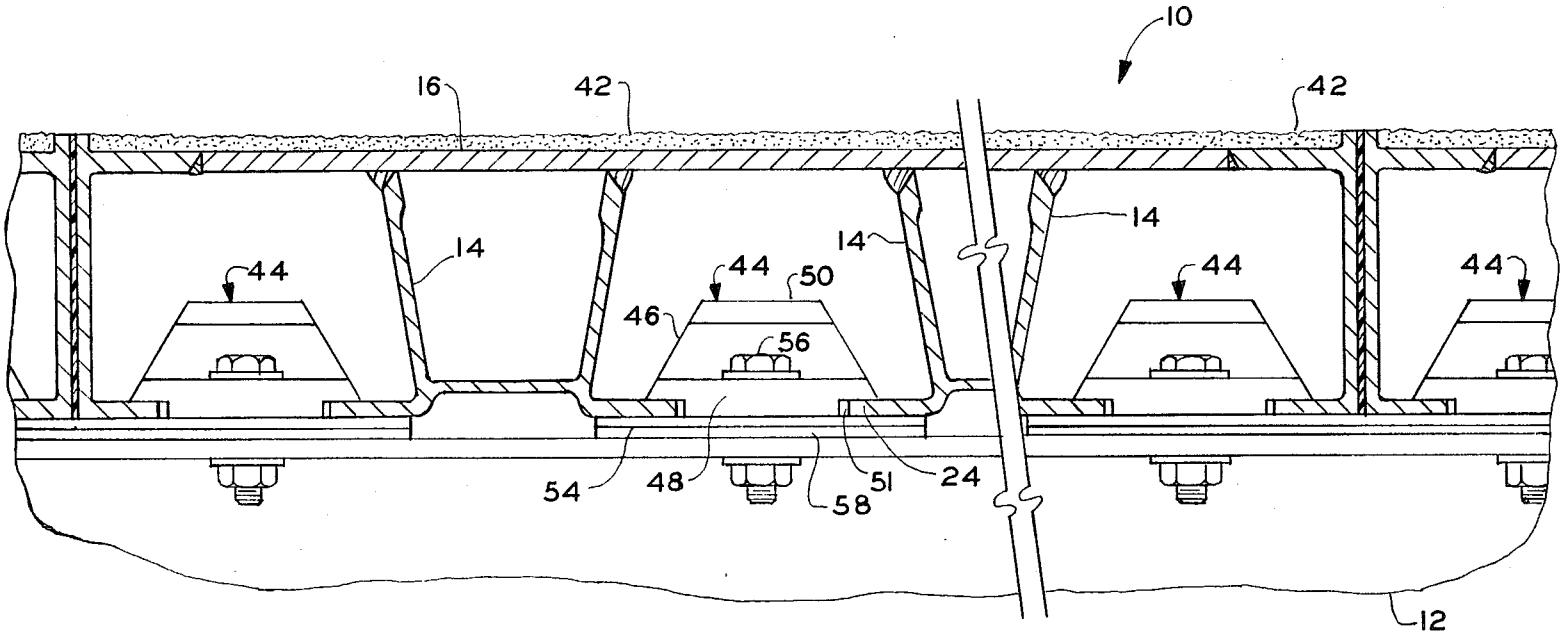
FIG. 1 is a cross-sectional view of a bridge deck system of this invention showing a bridge deck panel connected to an underlying member of a bridge structure.

A bridge deck panel 10 of a system of this invention as shown attached to a bridge stringer 12 in FIG. 1 is assembled from a plurality of ribbed aluminum extrusions 14 and an aluminum plate 16.

The aluminum alloys from which the extrusion and sheet are made are typically Aluminum Association alloy 6061-T6, ASTM Specification B221 for the extrusions and Aluminum Association alloy 5456-H116, ASTM Specifiction B209 for the plate. The thicknesses of the metal, configuration of the extrusions, spacing of the extrusions on the plate and other fabricating considerations are determined with reference to the load which the deck must sustain and the controlling design specification. Typically, bridges in the United States are designed to meet American Association of State Highway and Traffic Officials (AASHTO) standard specification. The bridge deck panels 10 will typically be fabricated into the largest size possible consistent with fitting the bridge dimensions and handling and shipping the panel. Because of length limitations for shipping, it is generally not practical to fabricate a panel longer than 40'0". Another factor to be considered in determining the optimum panel size is the orientation of the panel on the bridge structure. Some bridges are designed with stringers uniformly spaced apart running in the direction of the roadway or length of the bridge. In that case, it may be advantageous to design the panel to span all of the stringers. In other cases, it may be advantageous to use two panels to span the stringers with a butt joint along the centerline of the bridge. A typical four-lane highway bridge, for example, has 10 stringers approximately 7'0" on centers with the deck extending outwardly 3'6" beyond each of the outboard stringers to carry a parapet rail. The total out-to-out length of the deck spanning the width, therefore, would need to be approximately 70'0" and two lengths of approximately 35'0" deck panels can be conveniently used.

In another type of bridge structure, girders run the length of the bridge and beams run between the girders transverse to the length of the bridge or across the roadway. The Smithfield Street bridge referred to earlier has a structure of this type with the beams spaced a little greater than 9'0" apart and a total required deck width of 21'6". In that case, therefore, it was convenient to use panels which were typically 27'7⅜ long to span three beam spaces and 10'9" wide to cover one-half the width of the roadway.

Whether the length of the bridge deck panels 10 of a system of this invention run with the length of the bridge or transverse thereto, the system of attachment is the same. For ease of explanation, this preferred embodiment will be described as attached to bridge stringers.

Figure 2:
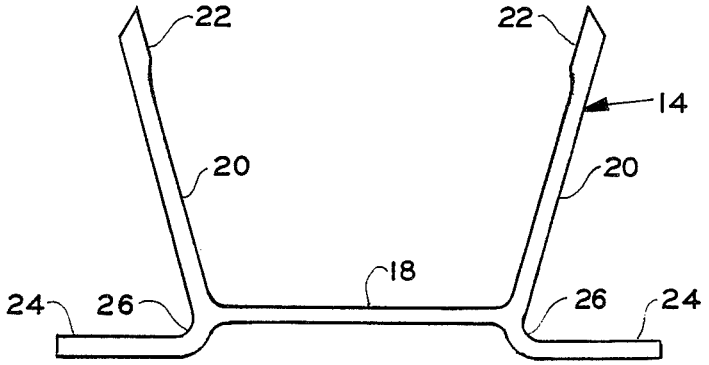
FIG. 2 is an end view of an extruded rib of a bridge deck panel in a system of this invention.

With reference now to FIG. 2, a typical ribbed extrusion 14 has a web 18 and a rib 20 projecting outwardly from each end thereof. The ribs will typically extend outwardly from the web 18 at an inside angle of slightly greater than 90° for structural design reasons. A beveled section 22 of increased thickness is provided at the free end of the ribs 20 to facilitate welding the extrusion to the plate. A flange 24 extends outwardly from each side of the extrusion near the junction of the ribs 20 with the web 18. The flanges 24 are for attaching the extrusion to the bridge support structure, as will be explained later. An arcuate wall portion 26 connects the flanges 24 with the web 18 in order to provide a space between the bottom surface of the web 18 and the plane of the bottom surfaces of the flange 24. The space is provided because in some installations bolt or rivet heads in the underlying bridge structure would interfere with setting the prefabricated deck panel thereon.

Figure 3:
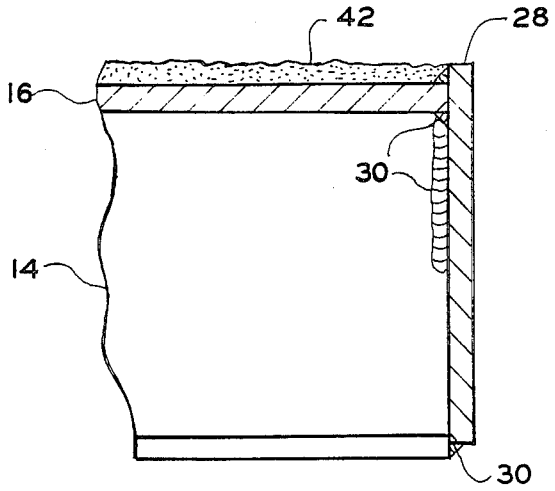
FIG. 3 is a cross-sectional view of an end closure of a bridge deck panel in a system of this invention.
Figure 4:
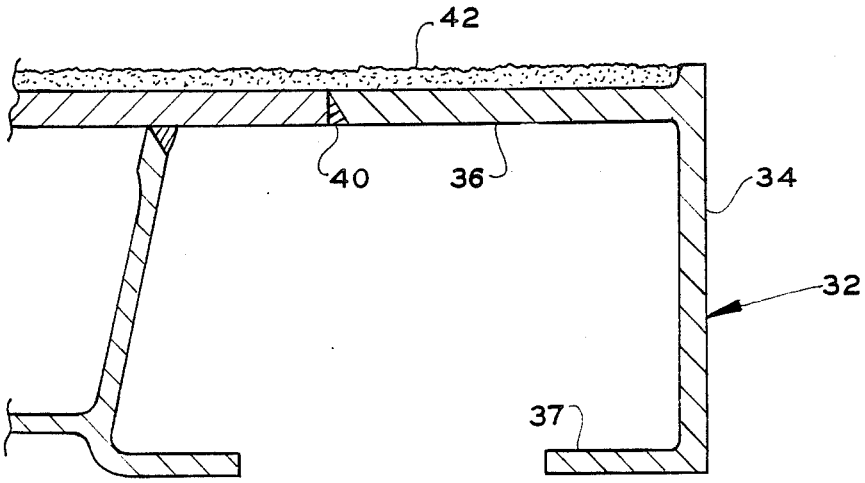
FIG. 4 is a cross-sectional view of a side closure of a bridge deck panel in a system of this invention.

In addition to the ribbed extrusions 14 in assembly with the deck plate 16, a typical deck panel of a system of this invention will include other members for closing the ends and sides of the panels as shown in FIGS. 3 and 4. To close the ends of the panel 10, an end plate 28 is attached to the deck plate 16 and ribbed extrusions 14 with continuous welds 30. Panel sides are enclosed with a side closure extrusion 32 having a web 34, an upper flange 36 extending outwardly therefrom adjacent the top and a lower flange 37 extending outwardly from the bottom. The side closure extrusion 32 is attached to each side of the deck plate with a continuous weld 40 extending the length of the panel.

Prefabrication of the deck panel 10 is completed by applying a traffic wear coating 42 to the outer surface of the deck plate 16. To determine a preferred surface, a number of polymer compounds embedded with a variety of aggregates were applied to a deck plate and tested for wear, skid resistance, salt spray and moisture corrosion resistance, weathering, freeze and thaw cycling and fatigue. Of the polymer type compounds tested, those which yielded the best overall results in response to the various aforementioned tests were epoxy binders with a basalt or blue stone aggregate embedded therein. A suitable thickness has been determined to be approximately $\frac{3}{8}$ inch.

Figure 5:
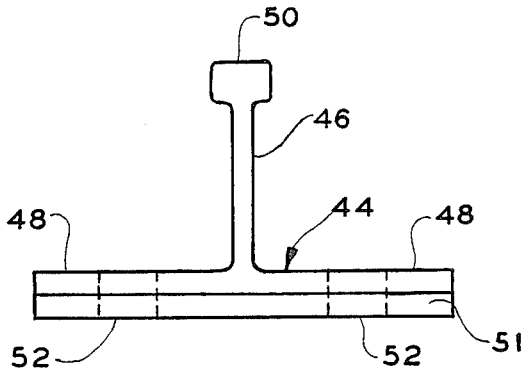
FIG. 5 is an end view of a bracket used for attaching a bridge deck panel to a bridge structure in a system of this invention.
Figure 6:
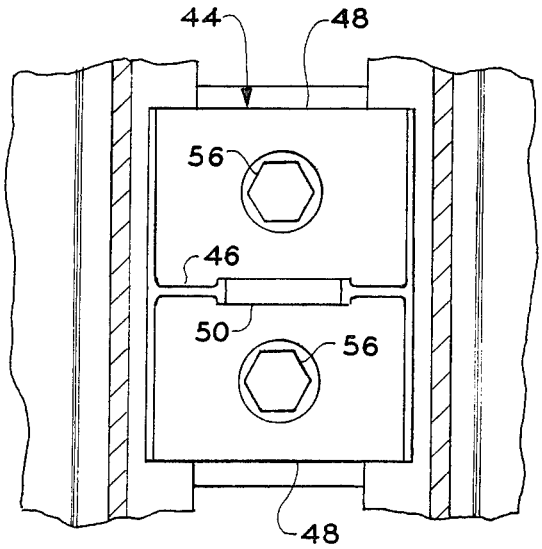
FIG. 6 a top view of the bracket shown in FIG. 5 in attachment with a member of a bridge structure and showing fragmentary portions of an extruded rib member of a bridge deck panel attached to the member of the bridge support with overlying portions of the bracket.

An important part of a system of this invention is the bracket 44 for fastening the panel 10 to a bridge structure as shown in FIG. 1 so that the panel can move in length and width directions independent of the bridge structure. Referring now to FIGS. 1, 5 and 6, the bracket 44 is a T-shaped member having an upright stem 46 and flanges 48 extending outwardly from both sides thereof to form a base. The free end of the stem 46 has a rectangular-shaped bulb 50 thereon for structural considerations. A length of extrusion is cut into pieces of suitable length to fit between the ribbed extrusions 14 with the stem 46 in a plane transverse to the ribbed extrusions 14, as shown in FIG. 1. The ends of each bracket are cut on a bias to further accommodate fitting the bracket between the extrusions. A predetermined length of the base is undercut away from each end of the bracket. The depth of the undercut 51 is substantially equal to the thickness of the ribbed extrusion flange 24. Bolt holes 52, shown in FIG. 5 as dashed lines, are provided through both flanges 48 to attach the bracket to the bridge structure.

Prior to assembly of the deck panels with the bridge structure, holes are provided through the top flange of the stringers of the bridge structure. The holes are spaced to align with the bracket holes except for the stringer which underlies the panel at or near the panel's midpoint in length. On this stringer, the holes are made to enable bolting the ribbed extrusion flanges 24 to the stringer. Bearing pads 54 having predrilled holes to align with the stringer flange holes are positioned on the stringer. Bearing pads are provided to guard against galvanic corrosion between the aluminum ribbed extrusions 14 or brackets 44 and the steel stringers. The bearing pads are preferably made of a synthetic material, such as polytetrafluoroethylene (PTFE), for example. Any other material which is electrically nonconductive, compatible with aluminum and steel, and able to sustain the weight of the deck and traffic loads thereon would be suitable. Shims 58, as required, to level the deck or provide a specified slope thereto are positioned between the bearing pads 54 and stringers 12. After the bearing pads 54 and shims 58 are in position, a deck panel 10 is laid across the bridge stringers for attachment thereto. Holes are drilled through the ribbed extrusion flanges 24 at or near its midpoint in alignment with the holes in the bridge stringer and a loosely bolted connection made therethrough. Next, brackets 44 are loosely attached to the stringers with bolts 56 and with the rib flanges 24 fitting in the bracket undercut. The bolts 56 used for making this connection as well as other connections noted in a description of this invention are preferably a corrosion resistant type, such as galvanized high strength steel or a suitable stainless steel, for example. It is to be noted that the undercut 51 in the bracket 44 is sufficient in length to provide a space between the toe of the rib flange 24 and the end of the undercut. As the final step in making the assembly between a deck panel 10 and the bridge, the bolts 56 are tightened to a prescribed torque. Other panels as necessary to complete the roadway are then installed, in a like manner, side-by-side or end-to-end to complete the roadway.

Figure 7:
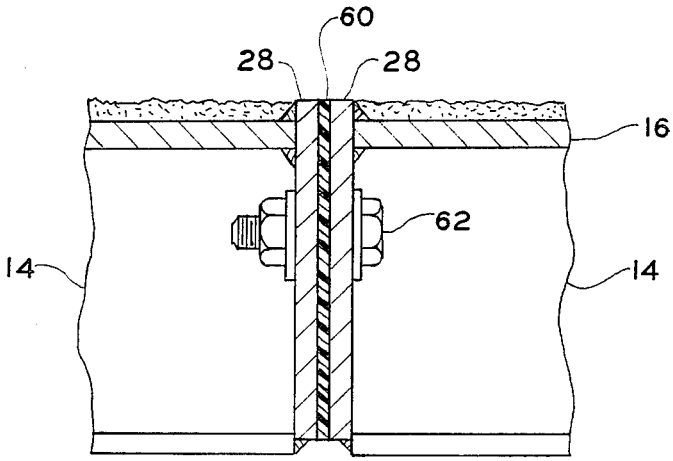
FIG. 7 is a cross-sectional view of an end-to-end connection of deck panels in a system of this invention.
Figure 8:
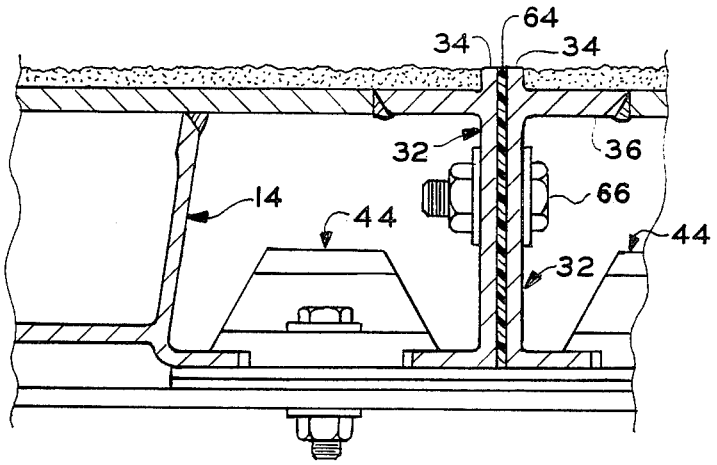
FIG. 8 is a cross-sectional view of a side-by-side connection of deck panels in a system of this invention with the panels running transverse to the bridge length.

For end-to-end connections, as shown in FIG. 7, a bituminous filler strip 60 of suitable width such as $\frac{1}{4}$ inch, for example, is placed between the end plates 28 and the panels are connected with a suitable number of bolts 62. It is noted that the end-to-end connection shown in FIG. 7 is satisfactory in those circumstances where the connection is not subject to substantial loads; for example, an end-to-end connection of panels running transverse to the bridge length with the connection along the centerline of the bridge. Typically, in such a case, a traffic barrier is installed down the centerline between opposing traffic lanes and thus the connection is not subject to vertically applied traffic loads. For side-to-side connections of panels, as shown in FIG. 8, a bituminous filler strip 64 is positioned between adjacent side member webs 34 and fastened together with a suitable number of bolts 66.

Figure 11:
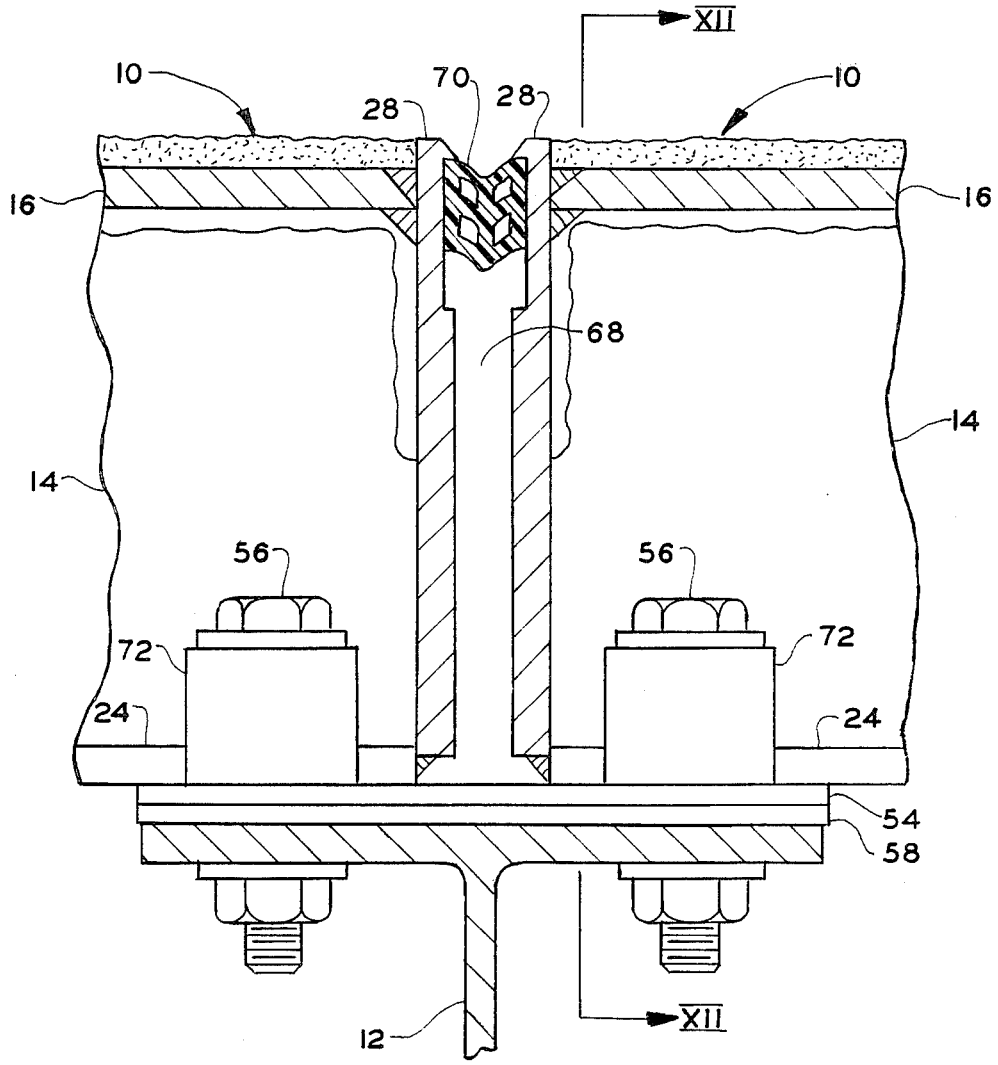
FIG. 11 is a cross-sectional view between ribbed extrusions of a typical end-to-end connection of deck panels in a system of this invention with the panels running lengthwise with the bridge.
Figure 12:
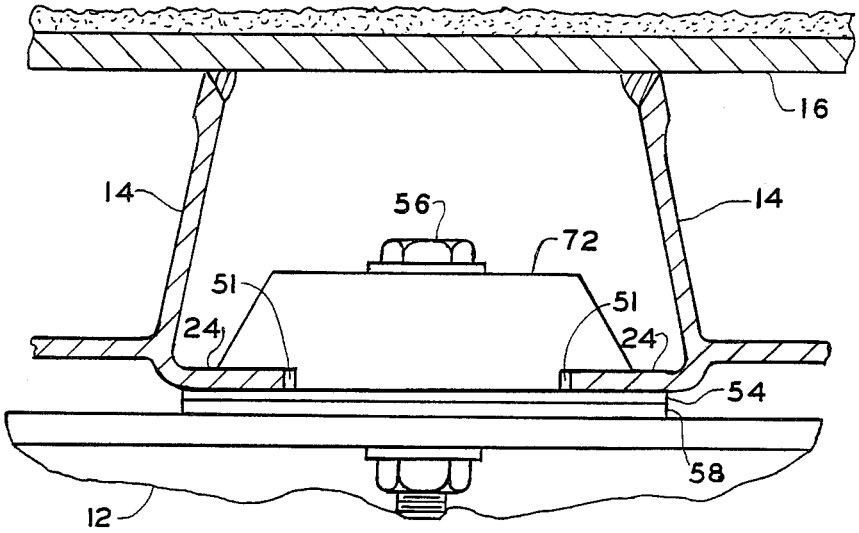
FIG. 12 is a cross-sectional view of a fragmentary portion of the end-to-end connection shown in FIG. 11 along section line XII—XII

It has been noted earlier that whether the panel 10 runs transverse to the bridge across stringers or lengthwise across beams, the system of attachment is the same. When running the panel 10 lengthwise, however, the detail of the end-to-end connection is different because of the need for supporting abutting ends on a common floor beam and the need for providing a wider space between the abutting ends to care for greater expansion. It is evident that the ends of panels 10 must rest on the bridge support when the panels run lengthwise with the bridge in order to carry traffic loads. It may also be seen that a greater allowance for expansion and contraction of the panels must be provided when panels as much as 40'0" long are assembled end-to-end on a long span bridge. A typical end-to-end connection of panels 10 running lengthwise on a bridge will be explained with reference to FIGS. 11 and 12. Abutting end-to-end panels 10, 10 are supported on a beam 12 of the bridge deck support with a bearing pad 54 and shim 58, as necessary, therebetween. A suitable gap 68, typically $\frac{3}{4}$ inch, is provided between end plates 28, 28 welded to the ribbed extrusions 14, 14 and deck plates 16, 16. An expansion joint seal 70 such as a neoprene seal, part No. E-1253, manufactured by the D. S. Brown Co. is adhesively bonded to the end plates 28, 28 to seal the gap 68. Brackets 72, 72 are used to anchor the ends of the panels 10, 10 to the beam 12. The bracket 72 to make this end connection has a recess or undercut 51 on each end to accommodate flanges 24, 24 of the ribbed extrusions 14, 14. As may be seen, this bracket 72 is configured differently than the typical brackets 44 used to attach interior portions of the deck 10 to the bridge structure since there is less flange area available for attachment. The bracket 72 is essentially a block having a thickness sufficient to resist the loads imposed upon it to satisfactorily anchor the deck. The bracket 72 can be made from bar or it can be extruded and cut to required widths to fit the beam flange. It is fastened to the beam flanges with bolts 56, 56 and functions in the same manner as a typical bracket 44.

A bridge deck system of this invention as just described is particularly advantageous in allowing sidewise and lengthwise movement of an aluminum deck independent of the bridge structure. The deck is restrained from lengthwise movement only by the frictional resistance between the ribbed extrusion 14 or the side closure member 32 held between the bracket 44 and bearing pad 54. To accommodate sidewise movement, the bracket 44 is undercut a sufficient length to provide space for movement of the ribbed extrusion flange 24 and side member flange 38. The bituminous filler strips between adjacent panels is sufficiently compressible to accommodate panel movement. The invention is not limited to an aluminum deck system, however. It is believed that even if both the deck and bridge structure have equivalent coefficients of expansion, a system of this invention would be advantageous in preventing high stress concentrations at the roadway surface due to temperature differentials. It is apparent that there may be a substantial difference in temperature between the deck and the underlying bridge structure. Independent movement of the deck may be advantageous, therefore, particularly if the deck panels are long, to accommodate differences in expansion due to such temperature differences.

Figure 9:
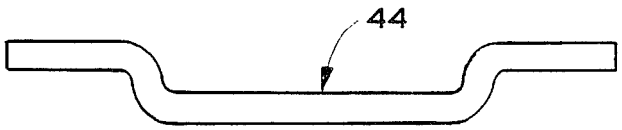
FIG. 9 is an end view of an alternate embodiment of a bracket suitable for use in a bridge system of this invention.
Figure 10:
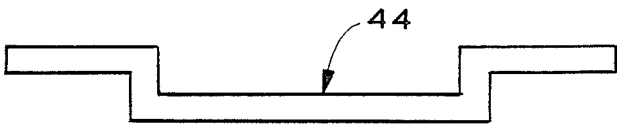
FIG. 10 is an end view of an additional alternate embodiment of a bracket suitable for use in a bridge system of this invention.
Figure 13:
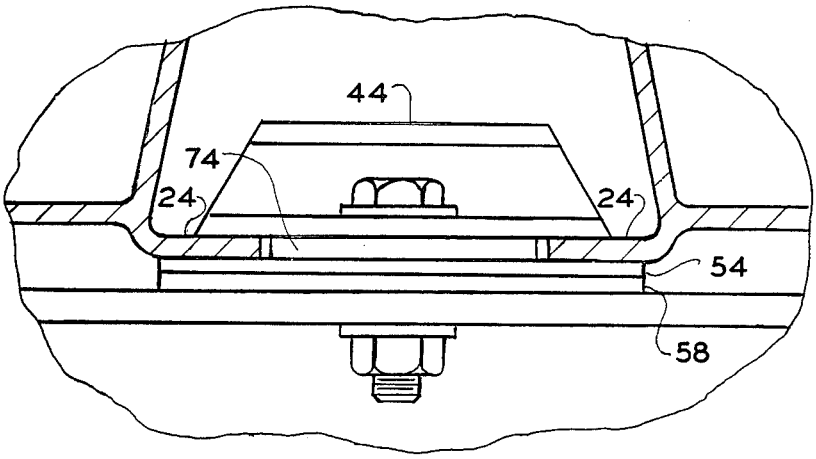
FIG. 13 is a cross-sectional view of a fragmentary portion of a bridge system of this invention showing an alternate embodiment of a bracket suitable for use in such a system.

It is also noted that the invention is not limited to the configuration of the bracket described in this preferred embodiment. Depending upon anticipated bridge loads, the bulb on the T-shaped bracket may be eliminated or a plate having a suitable undercut may suffice. It is only necessary that the bracket be sufficiently strong to carry the bending and shear loads induced thereupon. It is to be further noted that the undercut is not limited to being machined in the base of the bracket as shown in this preferred embodiment. If a plate shape was suitable for use as the bracket, for example, the undercut could be provided by deforming a portion of each end upwardly as shown in FIG. 9. An alternative plate-shaped bracket could also be provided by extruding a shape having a cross section like that shown in FIG. 10 and cutting the extrusion to appropriate bracket lengths. A further modification of a bracket suitable for use in a system of this invention is shown in FIG. 13. In this alternate embodiment, the bracket 44 is similar in all respects to that shown in FIGS. 1, 5 and 6 except it does not include an undercut on its ends. To space it apart from the bearing pad 54 and overlie the extrusion flanges 24, a shim or spacer 74 is interposed between the bracket and bearing pad 54 with the spacer having a thickness equal to the extrusion flange 24 thickness. All of the bracket embodiments have been shown as adapted to attach two adjacent rib members to the bridge structure with a single bracket. It is apparent that the deck could also be attached to the bridge structure with brackets which are adapted to cover only one rib member flange.

While the invention has been described in terms of preferred embodiments, the claims appended hereto are intended to encompass all embodiments which fall within the spirit of the invention.

What is claimed is:

1. A bridge deck system, comprising:

a bridge structure which includes spaced apart parallel members:

a rectangular deck panel having a deck plate attached to parallel spaced apart lineal ribbed members spanning the spaced apart members of the bridge structure and with the ribbed members having flanges extending outwardly from each side thereof; and a bracket attached between adjacent ribbed panel members to each of at least two of the parallel members of the bridge structure for connecting the deck panel thereto and having means for allowing movement of the deck panel in a lengthwise and sidewise direction independent of the bridge structure.

2. A bridge deck system as claimed in claim 1 which further includes bearing pads between members of the bridge structure and the brackets and the ribbed panel members attached thereto.

3. A bridge deck system as claimed in claim 1 wherein the bracket has a base and the means for allowing lengthwise movement is an undercut at each end thereof having a depth approximately equal to the thickness of the flange of the ribbed panel member with the portions of the base above the undercuts overlying at least a portion of the flanges of the ribbed panel members so that the deck panel is connected to the bridge structure but can move lengthwise.

4. A bridge deck system as claimed in claim 3 wherein the means to allow the panel to move in a sidewise direction independent of the bridge structure is providing a space between the outer edge of the flange and the portion of the bracket base which is the end of the undercut.

5. A bridge deck system as claimed in claim 3 wherein the bracket includes a stem extending upwardly from the base in a plane perpendicular to the base and transverse to the ribbed members.

6. A bridge deck system, comprising:

a bridge structure having spaced apart parallel members:

a deck plate having a top and bottom surface:

a ribbed member having a web and a pair of ribs extending upwardly from opposing ends of the web and having a flange extending outwardly from each rib near the junction of the rib and web:

a deck panel having a plurality of the ribbed members parallel and spaced apart with outer ends of the ribs attached to the bottom side of the deck plate and having the ribbed members spanning spaced apart members of the bridge structure: and a bracket having a portion of opposing ends overlying an undercut substantially equal in depth to the thickness of the flanges of the ribbed members and attached to a member of the bridge structure with opposing flanges of adjacent ribbed members fitting into the undercuts and having a space between an outer end of each flange and an end of the undercut within which the flange fits.

* * * * *